United States Patent [19]

Winter et al.

[11] 4,366,047

[45] Dec. 28, 1982

[54] COMBINATION HYDROREFINING, HEAT-TREATING AND HYDROCRACKING PROCESS

[75] Inventors: William E. Winter; Bong H. Chang, both of Baton Rouge, La.

[73] Assignee: Exxon Research and Engineering Co., Florham Park, N.J.

[21] Appl. No.: 269,590

[22] Filed: Jun. 2, 1981

[51] Int. Cl.[3] ..... C10G 45/02; C10G 69/00

[52] U.S. Cl. ..... 208/89; 208/49; 208/57; 208/68; 208/107; 208/108; 208/132; 208/264

[58] Field of Search ..... 208/89, 107, 108, 111, 208/56, 57, 68, 131, 132, 264

[56] References Cited

U.S. PATENT DOCUMENTS

| | | | |
|---|---|---|---|
| 2,889,263 | 6/1959 | Hemminger et al. | 208/89 X |
| 3,055,823 | 9/1962 | Mason et al. | 208/89 |
| 3,509,044 | 4/1970 | Adams et al. | 208/217 X |
| 3,730,875 | 5/1973 | Gleim et al. | 208/57 |
| 4,292,168 | 9/1981 | Derbyshire et al. | 208/107 |
| 4,298,457 | 11/1981 | Oblad et al. | 208/107 |

*Primary Examiner*—Delbert E. Gantz
*Assistant Examiner*—G. E. Schmitkons
*Attorney, Agent, or Firm*—Marthe L. Gibbons

[57] ABSTRACT

A process for upgrading a heavy hydrocarbonaceous oil is provided in which the oil is hydrorefined, heat-treated and hydrocracked to increase the selectivity of the hydrocracked product to components boiling in the range of 350° to 675° F.

7 Claims, 1 Drawing Figure

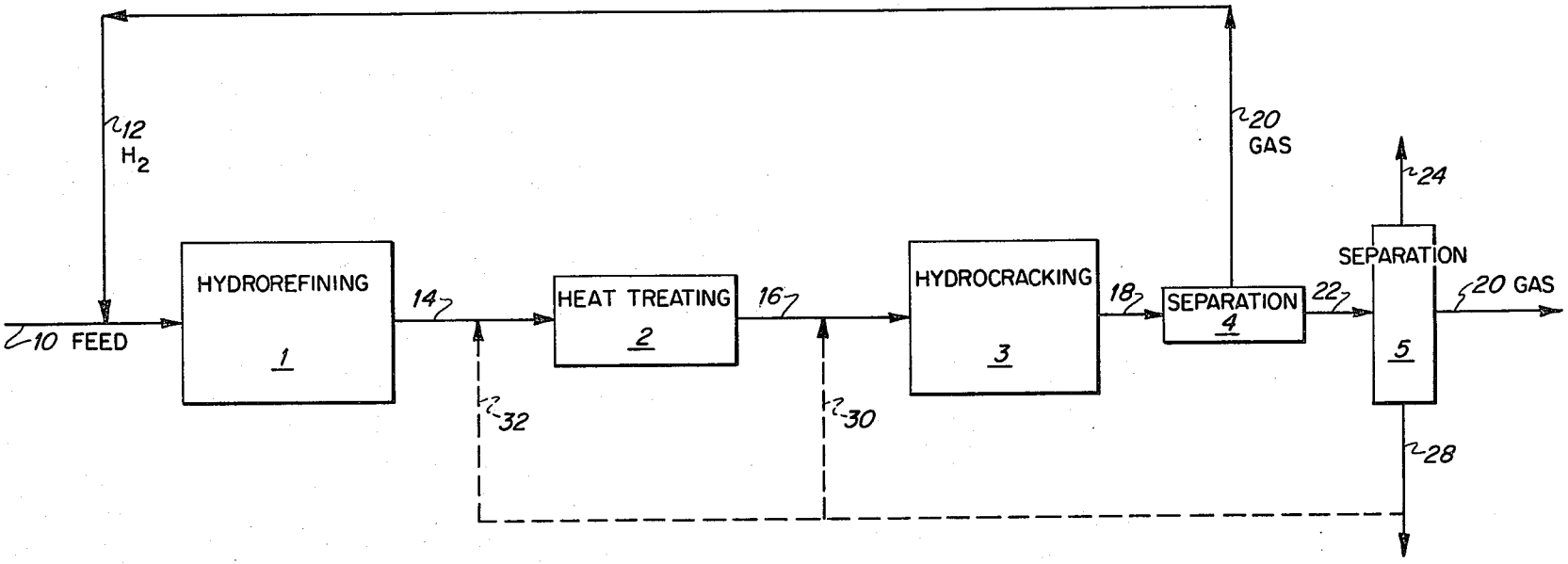
HYDROREFINING
1
HEAT TREATING
2
HYDROCRACKING
3
SEPARATION
4
SEPARATION
5
10 FEED
12 $H_2$
14
16
18
20 GAS
20 GAS
22
24
28
30
32

COMBINATION HYDROREFINING, HEAT-TREATING AND HYDROCRACKING PROCESS

BACKGROUND OF THE INVENTION

1. Field of the Invention

The present invention relates to an improved hydrocracking process. It particularly relates to a combination hydrorefining, heat-treating and hydrocracking process.

2. Description of the Prior Art

Hydrocracking is a well known process for upgrading hydrocarbon fractions. See, for example, Hydrocarbon Processing, Sept. 1976, pages 121–128. In the hydrocracking process, a hydrocarbonaceous oil is contacted in the presence of added hydrogen and a hydrocracking catalyst to produce lower boiling hydrocarbons. When the hydrocarbonaceous oil feed for the hydrocracking process comprises a high nitrogen content, the feed is usually hydrorefined in the presence of added hydrogen and a hydrorefining catalyst to decrease the nitrogen content of the feed prior to the hydrocracking stage.

U.S. Pat. No. 3,055,823 discloses a process which comprises hydrorefining a petroleum distillate boiling in the range of 200° to 850° F., preferably in the range of 325° to 650° F. to denitrify the distillate, removing ammonia from the hydrorefined effluent, heat treating the remaining hydrorefined effluent, and hydrocracking the heat treated effluent. In the heat treating zone, the hydrorefined effluent is passed through a siliceous cracking catalyst at conditions below which significant cracking occurs, i.e. below 650° F.

It has now been found that a specific sequence, including an intermediate heat treatment in the presence of hydrogen, will increase the selectivity of the hydrocracked product to components boiling in the range of about 350° to 675° F., i.e. components boiling in the jet fuel and diesel fuel ranges, when hydrocracking a feed boiling above 650° F.

SUMMARY OF THE INVENTION

In accordance with the invention there is provided, a process for upgrading a heavy hydrocarbonaceous oil feed, which comprises the steps of:

(a) contacting said oil feed with added hydrogen in the presence of a hydrorefining catalyst at hydrorefining conditions, in a hydrorefining zone;

(b) heat treating at least a portion of the entire effluent of said hydrorefining zone, said portion including normally liquid hydrocarbons and hydrogen, in a heat treating zone in the absence of a catalyst at conditions such as to avoid any significant cracking of said normally liquid hydrocarbons, said conditions including a temperature below about 720° F., for a period of time ranging from about 0.25 to about 6 hours;

(c) passing at least a portion of the entire heat-treated effluent, including hydrogen and normally liquid hydrocarbons to a hydrocracking zone;

(d) subjecting said portion of heat-treated effluent to hydrocracking conditions in the presence of a hydrocracking catalyst in said hydrocracking zone, and (e) recovering a hydrocracked normally liquid hydrocarbonaceous product.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, a heavy hydrocarbonaceous oil feed in admixture with a hydrogen-containing gas is passed by line 10 into hydrorefining zone 1. The hydrogen-containing gas which is introduced via line 12 into feed line 10 may be a fresh hydrogen-containing gas or a hydrogen-containing gas recycled from the process, as is well known in the art.

Heavy Hydrocarbon Feed

Suitable feeds passed into hydrorefining zone 1 include heavy hydrocarbonaceous oils boiling above about 650° F. at atmospheric pressure, such as, for example, petroleum crude oils, including heavy crude oils; heavy hydrocarbon distillates boiling in the range of about 650° to 1050° F. at atmospheric pressure, such as gas oils. The hydrocarbonaceous oils may be derived from any source such as tar sand oil; shale oil; liquids derived from coal liquefaction processes, and mixtures thereof. The feeds subjected to the hydrorefining step generally contain at least 100 wppm, typically at least 200 wppm nitrogen. Preferably, the heavy oil feed has at least 10 weight percent constituents boiling above 900° F.

The term "hydrorefining" is used herein to designate a catalytic treatment, in the presence of hydrogen, of a hydrocarbonaceous oil to upgrade the oil by eliminating or reducing the concentration of contaminants in the oil such as sulfur compounds, nitrogenous compounds, and metal contaminants and/or partial saturation of the feed.

Suitable operating conditions in the hydrorefining zone are summarized in the following table.

HYDROREFINING OPERATING CONDITIONS

| Conditions | Broad Range | Preferred Range |
|---|---|---|
| Temperature, °F. | 600–900 | 650–850 |
| Total pressure, psig | 50–3500 | 800–3200 |
| Liquid hourly space velocity, V/V/HR | 0.05–5.0 | 0.1–2.5 |
| Hydrogen rate, SCF/BBL | 300–20,000 | 600–12,000 |

The hydrorefining catalyst present in the hydrorefining zone can be any conventional nonacidic, i.e. noncracking hydrorefining catalyst. Suitable hydrorefining catalysts include a hydrogenation component, such as a Group VIB and a Group VIII metal, metal oxide, metal sulfide and mixtures thereof, composited with a noncracking carrier, such as cobalt, molybdenum, nickel, tungsten and mixtures thereof on alumina, which may additionally comprise minor amounts of silica, such as catalysts described, for example, in U.S. Pat. Nos. 3,770,618; 3,509,044 and 4,113,656, the teachings of which are hereby incorporated by reference.

At least a portion of the entire hydrorefining zone effluent is passed by line 14 into heat-treating zone 2. The portion passed into the heat-treating zone comprises hydrogen and normally liquid hydrorefined hydrocarbons. Ammonia and hydrogen sulfide formed during the hydrorefining reaction are not removed from the hydrorefined effluent passed into heat-treating zone 2. In heat-treating zone 2, the hydrorefined hydrocarbonaceous oil is treated under conditions to avoid any significant amount of cracking, that is, at conditions below thermal cracking conditions. Suitable conditions in the heat-treating zone include a temperature below about 720° F., preferably from about 500° to about 720° F., more preferably from about 500° to about 690° F., most preferably below 650° F., and a pressure ranging from about 500 to about 3000 psig for a time period ranging from about 0.25 hour to about 6 hours, preferably from about 0.3 hour to about 3 hours. Hydrogen is present in the heat-treating zone 2 since the hydrorefined effluent passed to the heat-treating zone comprised hydrogen. If desired, additional hydrogen may be introduced into heat-treating zone 2. The heat-treating zone may be an empty vessel or it may contain catalytically inert solids, such as mullite, quartz, pebbles, etc. At least a portion of the entire heat-treating zone effluent is passed by line 16 into hydrocracking zone 3 in which is maintained a hydrocracking catalyst. Any conventional hydrocracking catalyst having cracking activity and hydrogenation activity may be used in the hydrocracking zone, such as, for example, a platinum group metal-exchanged aluminosilicate zeolite, as shown, for example, in U.S. Pat. No. 3,329,627 or a mixed non-noble metal-containing zeolite, such as shown in U.S. Pat. No. 3,549,518.

Suitable hydrocracking conditions are summarized in the following table.

HYDROCRACKING CONDITIONS

| Conditions | Broad Range | Preferred Range |
|---|---|---|
| Temperature, °F. | 400–900 | 600–750 |
| Total pressure, psig | 500–3500 | 800–2500 |
| Liquid hourly space velocity, V/V/HR | 0.1–10 | 0.5–3 |
| Hydrogen rate, SCF/BBL | 300–20,000 | 600–12,000 |

The hydrocracking zone effluent is removed by line 18 from the hydrocracking zone. The effluent comprises hydrocracked normally liquid hydrocarbons and hydrogen. If desired, the hydrocracking zone effluent may be passed to gas-liquid separation zone 4 to separate a normally gaseous product from a normally liquid product. The gaseous product is removed by line 20. Optionally, the gaseous product, which comprises hydrogen, may be recycled to feed line 10, preferably after conventional removal of undesired constituents. The hydrocracked normally liquid hydrocarbonaceous oil is removed by line 22 and, if desired, it may be passed to separation zone 5 for fractionation by conventional means into various fractions, such as light, medium and heavy bottoms fractions. The bottoms fraction may be recycled into hydrocracking zone 3 by line 30 or recycled to heat-treating zone 2 by line 32.

EXAMPLE

A Cold Lake vacuum gas oil having a boiling point shown in Table I and a nitrogen content of 1260 wppm, a sulfur content of 3.62 weight percent and an API gravity at 60° F. of 16.3, was used as feed in a hydrocracking process in which the feed was first hydrorefined in reactor 1 ($R_1$) and then hydrocracked in reactor 2 ($R_2$) herein shown as process A and process B. A portion of the same initial feed was hydrorefined, heat-treated and then hydrocracked, herein designated process C. The results of these experiments are summarized in Table II.

TABLE I

FEED BOILING POINT RANGE
Distillation 15/5 as ASTM D-1160

| Components | °F. |
|---|---|
| IBP/5 vol. % | 487–633 |
| 10/20 | 672/711 |
| 30/40 | 743/774 |
| 50/60 | 801/828 |
| 70/89 | 866/896 |
| 90/95 | 940/958 |
| Final boiling point | 980 |

TABLE II

| | Process A | Process B | Process C |
|---|---|---|---|
| Process Conditions | | | |
| LHSV, $R_1$,(1) | .6 | .3 | .6 |
| Heat treating,(3) | — | — | 1.2 |
| $R_2$,(2) | 2.1 | 1.2 | .97 |
| Temp., °F., $R_1$ | 708 | 680 | 719 |
| Heat treating | — | — | 670 |
| $R_2$ | 701 | 700 | 671 |
| Treat Gas, SCF/B | | 600 SCF/B | |
| Total pressure, psig | | 1200 | |
| Yields | | | |
| $C_3^-$, wt. % | 1.1 | 1.6 | 1.0 |
| $C_4$, wt. % | 2.2 | 3.9 | 1.6 |
| $C_5$/350 vol. % | 30.8 | 42.8 | 28.8 |
| 350/675 vol. % | 41.9 | 39.2 | 47.8 |
| 675+ vol. % | 35.5 | 27.2 | 33.3 |
| Product Qualities | | | |
| 290/500° F., aromatics, vol. % | 31.8 | 30.4 | 26 |
| 350/675° F., aromatics, vol. % | 36.3 | 32.9 | 25 |
| 675° F. + API | 28.4 | 29.2 | 29.7 |
| Conradson Carbon, wt. % | — | — | — |
| $H_2$ Consumption, SCF/B | 1350 | 1575 | 1675 |

(1)$R_1$ contained a conventional hydrorefining catalyst comprising Ni—Mo on alumina.
(2)$R_2$ contained a conventional hydrocracking catalyst comprising Ni—Mo on a Y—zeolite.
(3)Inert solids were present in heat-treating zone.

As can be seen from Table II, Process C, which is a process in accordance with the present invention, gave a greater selectivity to components boiling in the 350° to 675° F. range (jet and diesel fuels) than the products produced by hydrocracking alone, without any significant increase in the amount of cracking of the product.

What is claimed is:

1. A process for upgrading a heavy hydrocarbonaceous oil feed, which comprises the steps of:

(a) contacting said oil feed with added hydrogen in the presence of a hydrorefining catalyst at hydrorefining conditions, in a hydrorefining zone;

(b) heat-treating at least a portion of the entire effluent of said hydrorefining zone, said portion including normally liquid hydrocarbons and hydrogen, in a heat-treating zone, in the absence of a catalyst at conditions such as to avoid any significant cracking of said normally liquid hydrocarbons, said conditions including a temperature in the range of about 500° to about 720° F., for a period of time ranging from about 0.25 hour to about 6 hours;

(c) passing at least a portion of the entire heat-treated effluent, including hydrogen and normally liquid hydrocarbons, to a hydrocracking zone;

(d) subjecting said portion of heat-treated effluent to hydrocracking conditions in the presence of a hydrocracking catalyst in said hydrocracking zone, and (e) recovering a hydrocracked normally liquid hydrocarbonaceous product.

2. The process of claim 1 wherein said heavy hydrocarbonaceous oil feed of step (a) has an atmospheric pressure boiling point of at least about 650° F.

3. The process of claim 1 wherein said heavy hydrocarbonaceous oil feed of step (a) has at least 10 weight percent constituents boiling above 900° F.

4. The process of claim 1 wherein said heat-treating conditions of step (b) include a temperature ranging from about 500° to about 690° F.

5. The process of claim 1 wherein said heat-treating of step (b) is conducted for a period of time ranging from about 0.5 to about 3 hours.

6. The process of claim 1 wherein said hydrorefining conditions in step (a) include a temperature ranging from about 600° to about 900° F. and a pressure ranging from about 50 to about 3500 psig.

7. The process of claim 1 wherein said hydrocracking conditions of step (d) include a temperature ranging from about 400° to about 900° F. and a pressure ranging from about 500 to about 3500 psig.

* * * * *